United States Patent [19]

Hediger

[11] Patent Number: 5,042,789

[45] Date of Patent: Aug. 27, 1991

[54] APPARATUS FOR THE ZIGZAG-SHAPED FOLDING AND STACKING OF A MATERIAL WEB

[75] Inventor: Hanspeter Hediger, Sempach-Stadt, Switzerland

[73] Assignee: Jos. Hunkeler, Ltd., Wikon, Switzerland

[21] Appl. No.: 404,876

[22] Filed: Sep. 8, 1989

[30] Foreign Application Priority Data

Sep. 9, 1988 [DE] Fed. Rep. of Germany ..... 3830789

[51] Int. Cl.[5] ..... B41L 1/32

[52] U.S. Cl. ..... 270/39; 493/413

[58] Field of Search ..... 270/30, 31, 39; 493/410–415, 434, 435

[56] References Cited

U.S. PATENT DOCUMENTS 3,972,519 8/1976 Melzer ..... 270/30

4,573,670 3/1986 Felix ..... 270/39

4,670,001 6/1987 Campbell .

FOREIGN PATENT DOCUMENTS 213429 3/1987 European Pat. Off. ..... 270/31

213430 3/1987 European Pat. Off. ..... 270/31

*Primary Examiner*—John T. Kwon

*Assistant Examiner*—Therese M. Newholm

*Attorney, Agent, or Firm*—Davis Hoxie Faithfull & Hapgood

[57] ABSTRACT

Apparatus for forming a stack of zigzag folding paper by feeding a web of cross-perforated paper from below through an oscillating gap onto the upper strands of bands, said apparatus having length-compensating means whereby the lengthening of the upper strand of one band powers the means for compensating for the increase in the length of the lower strand of the other band.

20 Claims, 3 Drawing Sheets

APPARATUS FOR THE ZIGZAG-SHAPED FOLDING AND STACKING OF A MATERIAL WEB

Figure 1:
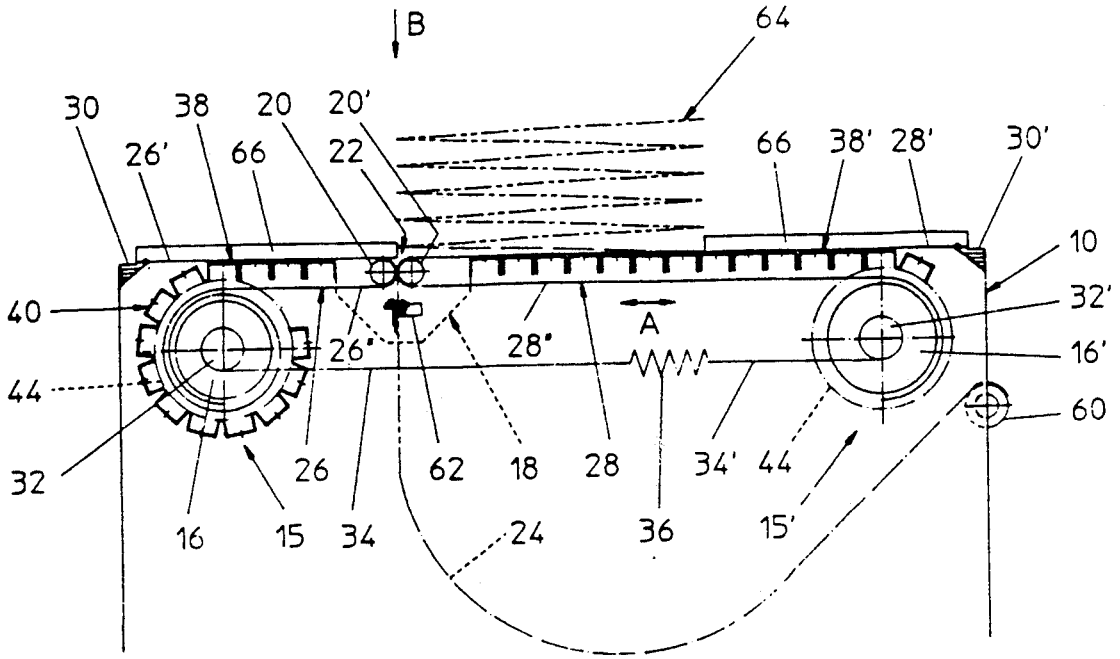

The present invention relates to an apparatus for the zigzag-shaped folding and stacking of a material web.

Such an apparatus is known from EP-A1 0,213,429. The deflecting rollers limiting a passage orifice for the material web fed from below are mounted rotatably at both ends on two endless toothed belts which run parallel to one another and which are driven by means of a stepping motor of reversible direction of rotation. Each of the two length-compensating arrangements of the supporting bands, each guided around one of the deflecting rollers, has a wind-on roller resting on a shaft and intended for the respective supporting band. Gear wheels, around which the toothed belts are respectively guided, are arranged fixedly in terms of rotation on these shafts at both ends. To make it possible to maintain the necessary tension in the supporting bands, resilient elements of a type corresponding to a spring-operated roller blind are provided between the respective drive shaft and wind-on roller. The drive for winding on of the supporting band, the upper strand of which follows the passage orifice, as seen in the direction of movement of the deflecting rollers, is thus obtained by means of the stepping motor, the drive force of which is transmitted directly to the wind-on rollers by means of the toothed belts. This known apparatus requires a considerable amount of space and has a construction involving a high outlay in terms of the length compensation of the upper strands of the supporting bands.

The object of the present invention is, therefore, to provide a space-saving apparatus of this general type for the zigzag-shaped folding and stacking of a material web, which has a constructively very simple and reliable drive for the length compensation of the upper strands of the supporting elements.

This object is achieved by means of an apparatus, as described below, wherein in the length-compensating means for the flexible band-shaped supporting means, the compensation means for the band whose upper strand is shortening is powered solely by the lengthening of the upper strand of the other band.

The two length-compensating arrangements alternately drive one another. The positive lengthening of one particular upper strand is utilized as a drive for shortening the other particular strand. There is therefore no longer any need for an external drive for the two length-compensating arrangements, this simplifying the construction considerably and thus also increasing the reliability and reducing the amount of space required.

An especially simple embodiment utilizes wind-on rollers drivingly interconnected. In the length-compensating arrangements, wind-on rollers are provided for the supporting elements designed as flexible bands. At the same time, the positive unwinding of that band of which the upper strand is lengthened during the shift of the deflecting members is utilized as a drive for winding on the other band.

In an especially preferred and simple embodiment, each wind-on roller is connected to a wind-on drum, on which a pull member is wound counter to the particular winding-on direction of the band. Because the two pull members are connected to one another prestressed, this ensures that the two bands are always under a predetermined tension. The rotation of one wind-on roller in the unwinding direction is likewise converted in the simplest possible way into a rotation of the other roller in the winding-on direction.

A likewise preferred embodiment wherein the supporting bands are directly connected to pull elements makes it possible, despite the mutual direct prestressing of the two supporting elements, to feed the material web to the passage orifice without difficulty. Thus, the lateral pull elements can be guided, for example, around rollers of fixed location and be prestressed relative to one another at their ends by means of springs. For this, the supporting elements need only be insignificantly longer than the largest length of the upper strand.

Further preferred embodiments are described hereinafter.

Figure 2:
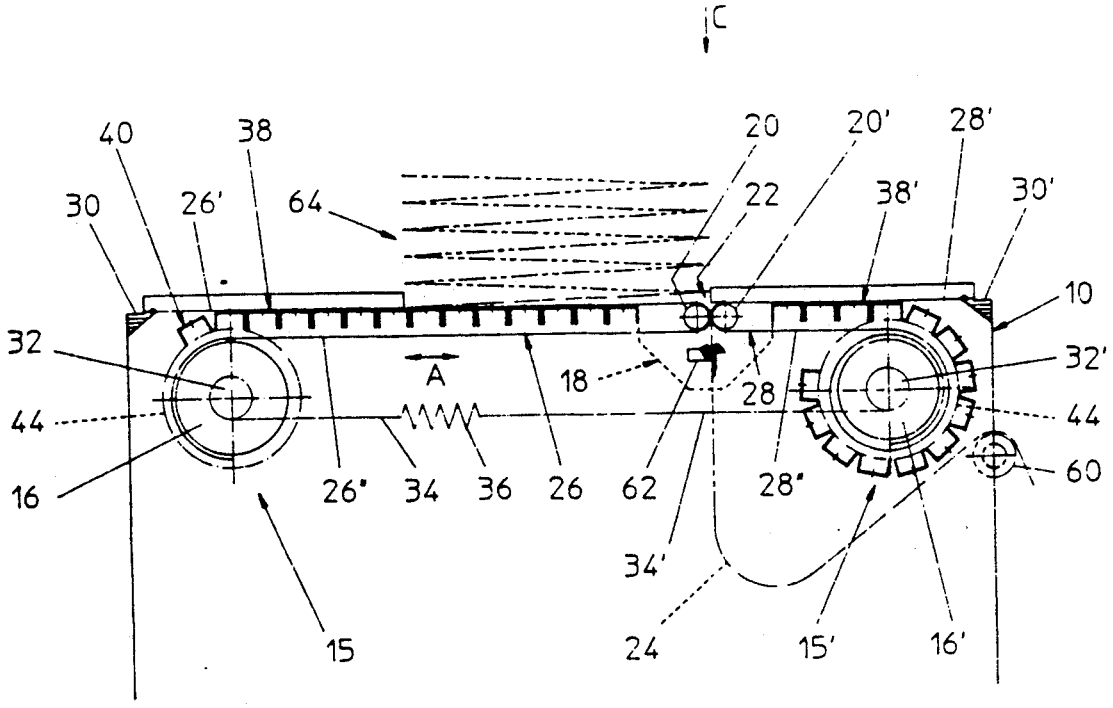
Figure 3:
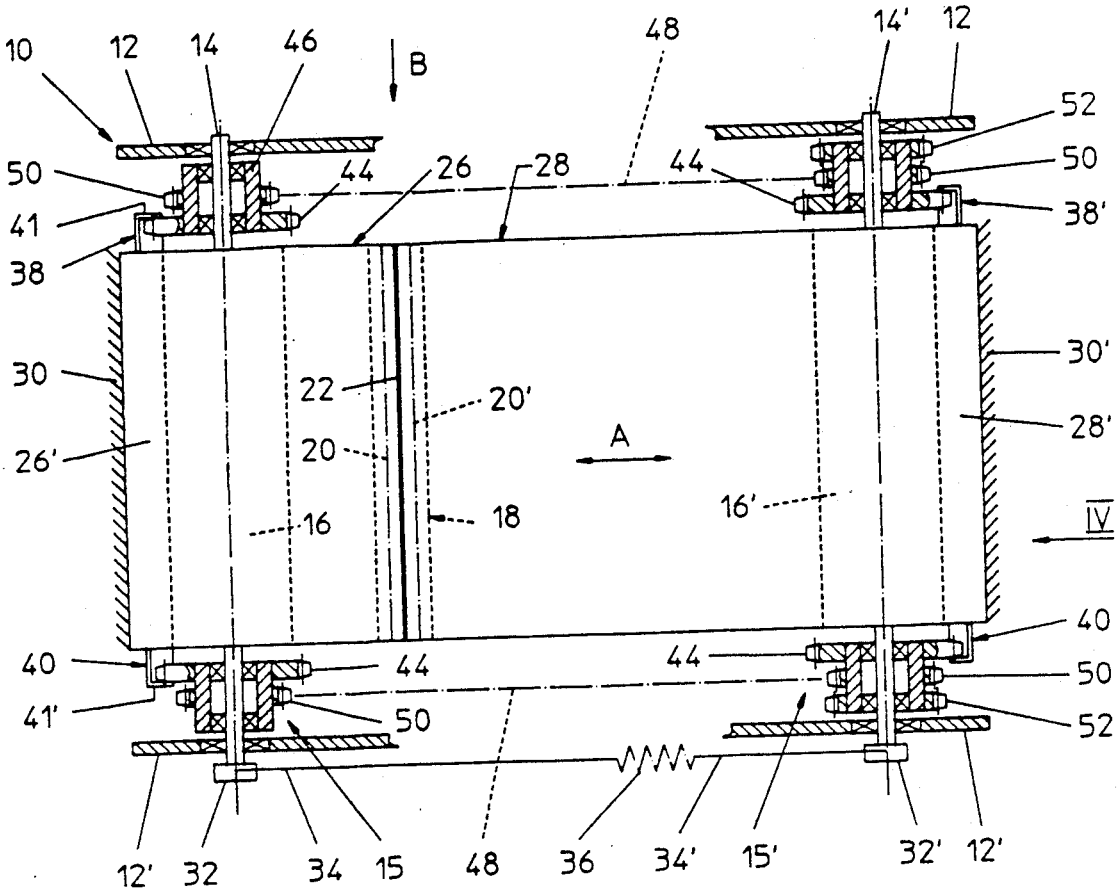
Figure 4:
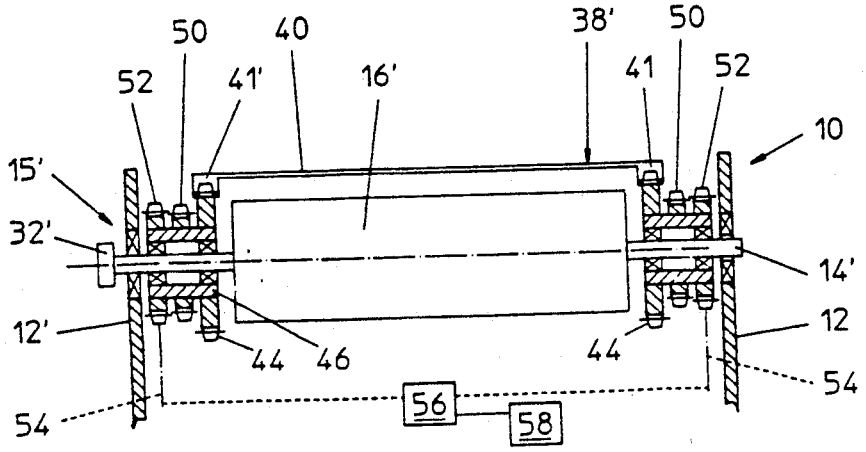
Figure 5:
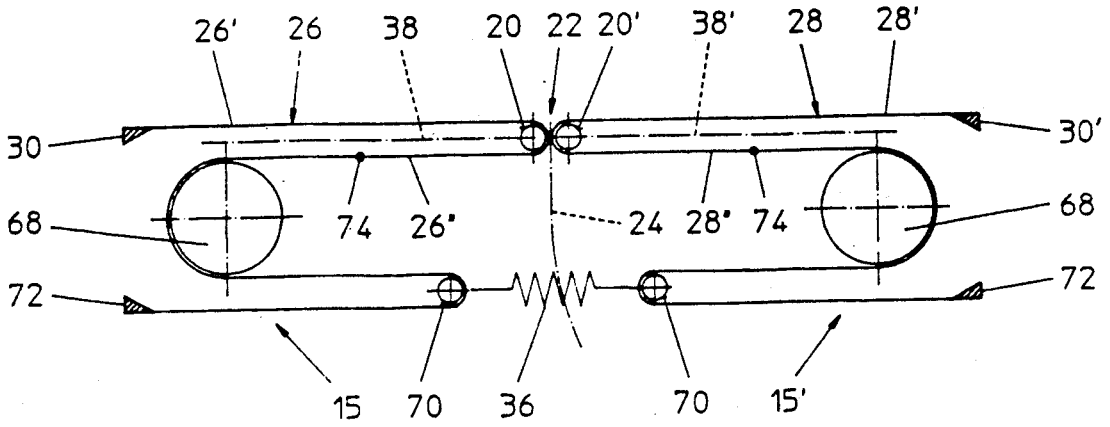
Figure 6:
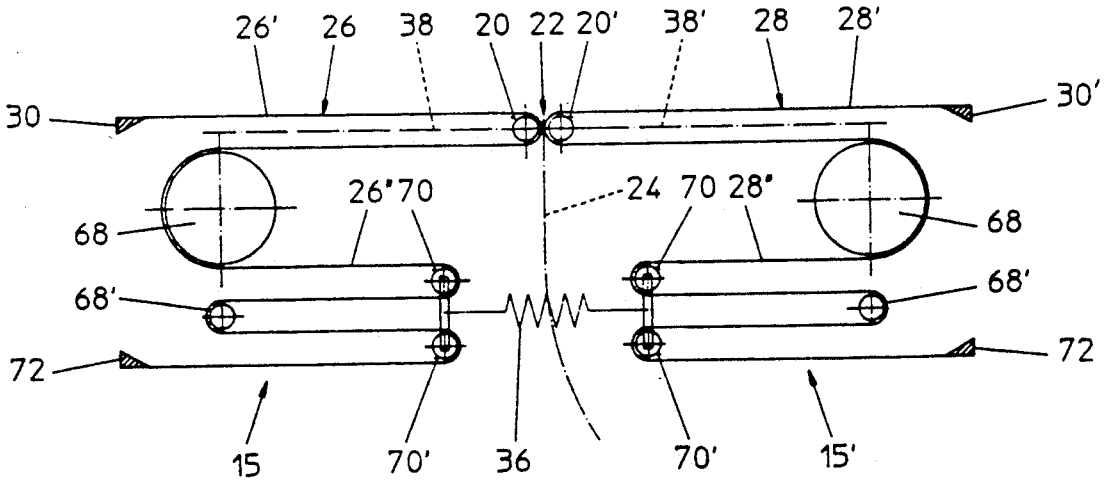

The present invention is now described in detail with reference to the accompanying drawings. In the purely diagrammatic drawings:

FIGS. 1 and 2 show a side view of a first embodiment of a folding and stacking apparatus, the deflecting rollers being in the two different end positions, FIGS. 3 and 4 shows respectively a simplified top view and end view of the folding and stacking apparatus according to FIG. 1, and FIGS. 5 and 6 show side views of two further embodiments of folding and stacking apparatuses represented in greatly simplified form.

The apparatus illustrated in FIGS. 1 to 4 has a stand 10, merely indicated, with two parallel vertical support plates 12, 12'. In FIGS. 1 and 2, the front support plate 12' is not shown for the sake of greater clarity. Two mutually parallel shafts 14, 14' of length-compensating arrangements 15, 15', on each of which a wind-on roller 16, 16' rests fixedly in terms of rotation, are mounted freely rotatable (see FIGS. 3 and 4) at the same height on the two bearing plates 12, 12'. Element 18 denotes a slide, merely indicated diagrammatically, which is driven movably to and fro in the direction of the arrow A in the region between the two wind-on rollers 16, 16'. In FIGS. 1 and 3, the slide 18 is shown in its left-hand end position, designated by B, and in FIG. 2 it is shown in its right-hand end position, designated by C. On the slide 18 there are provided two mutually parallel, freely rotatably mounted deflecting rollers 20, 20' which are aligned approximately at right angles to the direction of movement A of the slide 18 and which limit a gap-shaped passage orifice 22 for a material web 24 fed from below. Guided round each deflecting roller 20, 20' is a band 26, 28, the upper strands 26', 28' of which run from the deflecting rollers 20, 20' to corresponding fastening points 30, 30' of fixed location on the stand 10. The lower strands 26'', 28'' are guided by the corresponding deflecting rollers 20, 20' to the respective wind-on rollers 16, 16', to which these ends of the bands 26, 28 are fastened and onto which the end regions of the bands 26, 28 are wound.

A wind-on drum 32, 32', on which a rope (or line) 34, 34' is wound, rests fixedly in terms of rotation on each shaft 14, 14', the winding-on direction of the ropes 34, 34' being counter to the winding-on direction of the bands 26, 28 onto the respective wind-on rollers 16, 16'. The two ropes 34, 34' are prestressed relative to one another by means of a draw spring 36, as the result of which the two bands 26, 28 are always under an essentially constant tension. During the movement of the slide 18, for example from the left-hand end position B in the direction of the arrow A to the right-hand end position C, the band 26 is unwound positively from the wind-on roller 16 as a consequence of the lengthening of the upper strand 26'. The result of this is that the rope 34 is wound onto the wind-on drum 32, the result of which in turn, is that the other rope 34' is unwound from the wind-on drum 32' and the other band 28 is therefore wound positively onto the wind-on roller 16'. During the movement of the slide 18 in the opposite direction from the right-hand end position C to the left-hand end position B, therefore, the band 28 is unwound from the wind-on roller 16' as a consequence of the lengthening of the upper strand 28', the positive result of this being that the other band 26 is wound onto the wind-on roller 16. The drive of one length-compensating arrangement 15, 15' for winding on one band 26, 28 is thus obtained solely as a result of the unwinding of the other band 28, 26 from the corresponding wind-on roller 16', 16 of the other length-compensating arrangement 15', 15.

Each upper strand 26', 28' is supported in the region between the slide 18 and the shafts 14, 14', by a stay element 38, 38'. The two stay elements 38, 38' are of identical design and have a plurality of mutually parallel downwardly open U-shaped stay members 40 which are fastened at both ends to portions of respective finite rollers chains 41, 41' (see FIGS. 3 and 4). The rollers chains 41, 41' are fastened centrally to the slide 18 and at both ends are guided to gearwheel-shaped wind-on wheels 44, fastened to these and wound partially onto them.

Each of the four wind-on wheels 44 rests fixedly in terms of rotation on a hollow shaft 46 which is respectively mounted freely rotatably on the shafts 14, 14' in the region between the two wind-on rollers 16, 16' and the bearing plates 12, 12'. The two hollow shafts 46 provided on the same side of the wind-on rollers 16, 16' are operatively connected to one another by means of a chain drive 48 or another pull means represented by dot-and-dash lines, the chain wheels 50 of these chain drives 48 resting fixedly in terms of rotation on the hollow shafts 46. Arranged fixedly in terms of rotation on each of the two hollow shafts 46 mounted freely rotatably on the shafts 14' is a further chain wheel 52 which is operatively connected to a path-conscious drive unit 56 via further chain drives 54 likewise represented merely by dot-and-dash lines. The drive unit 56 is an electric drive motor which is regulated in a path-conscious way and the direction of rotation of which is reversible by means of a control 58 (see FIG. 4); for example, a stepping motor can be provided.

In order to move the slide 18 from the end position B shown in FIGS. 1 and 3 into the end position C shown in FIG. 2, the drive motor 56 drives the two hollow shafts 46 resting on the shaft 14' in the clockwise direction. This rotary movement is transmitted by means of the chain drives 48 to the hollow shafts 46 mounted on the shaft 14. At the same time, the stay element 38' shown on the right in FIGS. 1 to 3 is wound onto the wind-on wheels 44 assigned to the shaft 14' and the other stay element 38 is unwound from the wind-on wheels 44 assigned to the shaft 14, the drive force for the slide 18 being transmitted from the drive unit 56 to the slide 18 via the roller chains 41, 41'. During the movement of the slide 18 in the opposite direction, the stay element 38 is therefore wound on again and the stay element 38' unwound, as illustrated in FIGS. 1 and 2.

The material web 24, sagging freely, is guided to the slide 18 from below by a generally known transport device 60 arranged on the stand 10. The transport device 60 draws the material web 24 to be folded, for example from a supply roll. On the slide 18, underneath the passage orifice 22, there is provided a return stop 62 for the material web 24, which prevents the material web 24 from sliding back from the slide 18 to the transport device 60. As seen in the feed direction of the material web 24, the material web 24 runs from the return stop 62 through the passage orifice 22 to a stack 64 which rests on the upper strand 28' or 26'. The material web 24 has perforations arranged at a specific distance behind one another and running at right angles to its longitudinal extension. At each perforation, the material web 24 is folded by means of the apparatus illustrated in FIGS. 1 to 4, so that the zigzag-shaped stack 64 forms from the material web 24 as indicated by dot-and-dash lines in FIGS. 1 and 2. Fences arranged on the stand 10 and intended for supporting the stack 64 laterally on the folding side are designated by 66. It is necessary to ensure that the stroke of the slide 18 from one end position to the other B, C is slightly greater than the distance between the two fences 66.

The folding and stacking operation is generally known and is described in detail, for example, in EP-B1-0,144,861 or the corresponding U.S. Pat. No. 4,573,670. In the position B of the slide 18, as shown in FIG. 1, the stack 64 rests on the band 28 supported by the stay element 38' and the material-web portion between the stack 64 and the return stop 62 likewise rests on the band 28 in the region of the passage orifice 22. At the start of the movement of the slide 18 under the stack 64 from the left-hand end position B towards the right-hand end position C, this portion of the material web 24 lifts off from the band 28 in the region of the passage orifice 22 and, since the material web 24 of course cannot slide away downwards because of the return stop 62, is bulged out and laid partially against the other band 26. During the further movement of the slide 18, the material web 24 is folded in the region of this bulge and thus gripped between the stack 64 and the band 26. During the further movement of the slide 18, the material web 24 is now tightened, until the slide 18 has reached the right-hand end position C shown in FIG. 2. A folding of that portion of the material web 24 located in the region of the passage orifice 22 then takes place in a similar way in the opposite direction. The stack 64 thus builds up from the bottom upwards. For the sake of completeness, it should also be mentioned that, when a new material web 24 to be folded is being drawing in, the leading edge is brought to bear against one fence 66. This ensures that the material web 24 is folded at the perforations.

The slide 18 is driven to move to and fro by the drive unit 56 via the stay elements 38, 38', in order to fold the fed material web 24 and form a stack 64 from it. The positive lengthening of the upper strand 26', 28' of the band 26, 28 preceding the passage orifice 22, as seen in the particular direction of movement of the slide 18, is completed by the unwinding of this band 26, 28 from the respective wind-on roller 16, 16'. Because of the coupling between the two wind-on rollers 16, 16' by means of the wind-on drums 32, 32', the ropes 34, 34' and the draw spring 36, this unwinding causes the other band 28, 26 to be wound onto the respective wind-on roller 16', 16, so that its upper strand 28', 26 is shortened.

In FIGS. 5 and 6, two further embodiments very similar to the apparatus according to FIGS. 1 to 4 are illustrated in greatly simplified form, only the two bands 26, 28 and the corresponding length-compensating arrangements 15, 15' being shown. The stay elements 38, 38' are indicated by dot-and-dash lines. As in the embodiment described above, the upper strands 26' 28' of the two bands 26, 28 run from the fastening points 30, 30' at fixed location to the deflecting rollers 20, 20' limiting the passage orifice 22.

In the embodiment according to FIG. 5, the lower strands 26'', 28'' are respectively guided in an S-shaped manner round a deflecting roller 68 mounted rotatably at a fixed location and round a free deflecting roller 70. The two free deflecting rollers 70 are prestressed relative to one another by means of a draw spring 36, and those ends of the bands 26, 28 on this side are fastened to further fastening points 72 of fixed location on the strand which is not shown in this figure.

In the embodiment according to FIG. 6, the lower strands 26'', 28'' are alternately guides respectively round two deflecting rollers 68, 68' mounted freely rotatably at a fixed location and free deflecting rollers 70, 70'. In a similar way to the embodiment according to FIG. 5, the bands 26, 28 are likewise fastened, at the end of this side, to fastening points 72 of fixed location, and the two free deflecting rollers 70, 70' of one band 26 are prestressed relative to the corresponding deflecting rollers 70, 70' of the other band 28 by means of draw springs 36. In the two embodiments according to FIGS. 5 and 6, the material web 24 is guided from below between the lateral draw springs 36 and the corresponding free deflecting rollers 70, 70' to the passage orifice 22.

In the embodiments according to FIGS. 5 and 6, the length compensating of the upper strands 26', 28' of the two bands 26, 28 takes place as follows: during the positive lengthening of an upper strand 26', 28' as a result of the shift of the passage orifice 22 and of the deflecting rollers 20, 20', a shortening of the respective lower strands 26'', 28'' occurs. The result of this is that the distance between the deflecting rollers 68, 68' of fixed location and the free deflecting rollers 70, 70', round which the respective band 26, 28 is guided, decreases. The movement of the free deflecting rollers 70, 70' is transmitted to the deflecting rollers 70, 70' of the other band 28, 26 by means of the draw springs 36, the result of this being that this band 28, 26 always remains tensioned, and during the shortening of the upper strand 28', 26' the lower strand 28'', 26'' is lengthened.

It is possible, in these two embodiments, for the stay elements 38, 38' to be wound onto wind-on wheels mounted separately from the length-compensating arrangements 15, 15', or for the lateral roller chains 41, 41' to be made endless and guided round deflections.

It is also possible for the bands 26, 28 to be only slightly longer than the greatest possible length of the upper strands 26', 28'; in this case, the bands 26, 28 at least also extend around the corresponding deflecting rollers 20, 20'. At the free end, designated by way of example by 74 in FIG. 5, each band 26, 28 can then be connected to two pull elements at the sides of the band. The pull elements, in a similar way to the lower strands 26'', 28'' according to FIGS. 5 and 6, are guided round deflecting rollers 68, 68' of fixed location and free deflecting rollers 70, 70'. The space between the two pull elements is thus free for feeding the material web 24. Such an embodiment of the two bands 26, 28 with side pull elements also makes it possible to deflect each of the pull elements around only a single deflecting roller corresponding to the deflecting rollers 68 according to FIG. 5 and to prestress relative to one another, by means of springs 36, those ends of the side pull elements remote from the bands 26, 28. The free deflecting rollers 70 and fastening points 72 shown in FIG. 5 can then be omitted.

If the prestress in the supporting elements 26, 28 is maintained by other generally known means, such as, for example, weight levers, the draw springs 36 can be omitted and these can be replaced by inelastic connecting elements, or, in the embodiment described last, the pull elements can connect the ends of the lower strands of the bands 26, 28 to one another directly.

It would also be possible for the drive to act directly on the slide 18 in a to-and-fro movement. Likewise, the stay elements 38, 38' or the roller chains 41, 41' can be guided in side guide arrangements in the load-bearing region.

I claim:

1. A space-saving bottom-fed stacking apparatus for forming a zigzag folded stack from a continuous cross-perforated material web comprising:

a. a pair of driven, reciprocatably translatable spaced apart deflection means;

b. a pair of oppositely oriented, flexible band shaped supporting means, each associated with a deflection means and each i. having a fixed upper end, ii. passing downwardly around the associated deflection means, thereby defining a reciprocatably translatable feed gap for said web, iii. having a stack-supporting upper strand extending from said fixed upper end to said deflection means, which upper strand alternately lengthens and shortens with reciprocating translation of said deflection means, and iv. having a lower strand which alternately lengthens and shortens oppositely from said upper strand;

c. for each supporting means, length compensating means driven by translation of the deflection means for lengthening said upper strand and shortening said lower strand; and d. coupling means drivingly connecting said length compensating means for alternately shortening the upper strand and lengthening the lower strand of one of said pair of supporting means solely by operation of the other supporting means driven by translation of the deflection means.

2. Apparatus according to claim 1 wherein each supporting means is a flexible band, wherein each length-compensating means comprises a wind-on roller for the lower strand of said band, and wherein rotation in the winding-on direction of the roller for the band whose upper strand is shortening is caused by rotation in the unwinding direction of the roller for the band whose upper strand is lengthening.

3. Apparatus according to claim 2 wherein each length-compensating means comprises a wind-on drum operatively fixed to rotate with said wind-on roller and a pull member wound on said drum counter to the winding-on direction of the band, and wherein said coupling means comprises a prestressed connection of said pull members.

4. Apparatus according to claim 3 wherein each pull member is a rope.

5. Apparatus according to claim 3 wherein said coupling means comprises an elastic element.

6. Apparatus according to claim 5 wherein said elastic element is a spring.

7. Apparatus according to claim 2 additionally comprising a pair of stay element means, each drivingly connected to one of said spaced apart deflection means for supporting the flexible band associated therewith.

8. Apparatus according to claim 7 additionally comprising, for each stay-element means, stay-element wind-on means and reversible drive means for reciprocatingly translating said deflection means through said stay-element means.

9. Apparatus according to claim 8 wherein the wind-on roller associated with one band and the stay-element wind-on means associated with the same band are coaxial and wherein said drive means acts on said stay-element wind-on means.

10. Apparatus according to claim 1 wherein the lower strand of each supporting means comprises two side pull elements with a web-accessing space therebetween.

11. Apparatus according to claim 10 wherein said coupling means comprises a common prestressed connection.

12. Apparatus according to claim 11 wherein said common prestressed connection comprises an elastic element.

13. Apparatus according to claim 10 wherein each side pull element has a fixed lower end terminating said supporting means, wherein said length compensating means comprises at least one fixed deflecting roller and one free deflecting roller, and wherein said coupling means comprises a prestressed connection of said free deflecting rollers.

14. Apparatus according to claim 10 wherein each side pull element has a lower end terminating said supporting means and wherein the lower ends of the side pull elements of one supporting means are connected to the lower ends of the side pull elements of the other supporting means.

15. Apparatus according to claim 14 wherein the lower ends of the side pull elements are connected by means of elastic elements.

16. Apparatus according to claim 1 wherein each lower strand has a fixed lower end terminating said supporting means, wherein each said length compensating means comprises at least one fixed deflecting roller and one free deflecting roller, and wherein said coupling means comprises a prestressed connection of said free deflecting rollers.

17. Apparatus according to claim 1 additionally comprising stay element means supporting said flexible band supporting means and drivingly connected to said spaced apart deflection means.

18. Apparatus according to claim 17 additionally comprising stay-element wind-on means and reversible drive means acting on said deflection means through said stay-element wind-on means.

19. Apparatus according to claim 1 additionally comprising a web return stop located beneath said deflection means.

20. Apparatus according to claim 1 additionally comprising e. a reversible path-conscious drive for said deflection means; and f. reversing control means for said drive.

* * * * *